US005906062A

United States Patent [19]

Kuhn

[11] Patent Number: 5,906,062

[45] Date of Patent: May 25, 1999

[54] NEEDLEPOINT FABRIC MOUNT

[76] Inventor: Frederick A. Kuhn, 14 Hull Ave., Winnipeg, Manitoba, Canada, R2M 0Y8

[21] Appl. No.: 08/955,285

[22] Filed: Oct. 21, 1997

[51] Int. Cl.[6] ..... D06F 3/08

[52] U.S. Cl. ..... 38/102.1; 38/102.91; 160/392

[58] Field of Search ..... 38/102.1, 102.91, 38/102.21, 102.3; 160/375, 378, 392, 395; 101/127.1

[56] References Cited

U.S. PATENT DOCUMENTS

| | | | |
|---|---|---|---|
| 728,682 | 5/1903 | Dedicke | 38/102.3 |
| 960,468 | 6/1910 | Weller | 160/375 |
| 2,893,162 | 7/1959 | Knowles | 38/102.1 |
| 3,205,547 | 9/1965 | Riekse | 160/392 X |
| 3,482,343 | 12/1969 | Hamu | 38/102.91 |
| 3,553,862 | 1/1971 | Hamu | 38/102.1 |
| 4,041,861 | 8/1977 | Alter | 38/102.91 X |
| 4,322,901 | 4/1982 | Spitzke | 38/102.91 X |

FOREIGN PATENT DOCUMENTS

| | | | |
|---|---|---|---|
| 2194803 | 3/1988 | United Kingdom | 38/102.1 |

*Primary Examiner*—Ismael Izaguirre

*Attorney, Agent, or Firm*—Adrian D. Battison; Murray E. Thrift

[57] ABSTRACT

A needlepoint fabric mount includes two fabric support bars and two parallel side rails for supporting the bars in spaced position to hold the sheet of fabric in taut condition between the bars. Each bar holds the fabric by an elongate longitudinal slot with an elongate rigid locking bar inserted into the slot and for locating the strip therein. The bar and the slot are shaped such that the bar can be loosely inserted into the slot through the open mouth on top of the strip and such that tension in the fabric from one side of the transverse member pulls one side of the bar member into engagement with an adjacent slot side to pinch the fabric between the bar and the slot side. The bar is triangular in cross-section and the slot side is inclined from the surface of the transverse member at an angle greater than ninety degrees. The side rails and the bars are rectangular in cross-section defining a side containing the fabric. Each of the side rails includes a guide slot and at least one of the transverse members includes opposed portions thereof engaging into respective ones of the guide slots for longitudinal sliding movement therealong. One of the transverse members is mounted for course adjustment in the longitudinal direction and the other of the transverse members is arranged for fine adjustment in the longitudinal direction.

19 Claims, 5 Drawing Sheets

NEEDLEPOINT FABRIC MOUNT

This invention relates to a fabric mount for supporting a sheet of fabric for use in needlepoint, cross-stitch or similar embroidery techniques in which the fabric mount is supported by a user for manual application of stitches or similar to the sheet of fabric. The fabric mount is generally in the form of a frame into which the fabric is inserted.

BACKGROUND OF THE INVENTION

Frames for needlepoint or similar techniques support a strip of fabric so that the user can apply stitches to the fabric. The fabric needs to be maintained generally taut and this is done generally by grasping top and bottom edges of the fabric and by pulling them apart. Usually the side edges are free. The frames can be relatively small so that they are simply held manually and manipulated to the required orientation. Other frames are larger and are carried on a support.

One type of frame includes a pair of rollers which are carried in two side rails in spaced parallel position so that the rollers can be rotated to roll up and pay off the fabric and thus provide the necessary tension.

Another type of frame includes two side rails which are threaded and the transverse bars attached to the fabric carry nuts which are thus driven longitudinally along the side rails when the side rails are rotated thus increasing or decreasing the spacing between the transverse bars and provide the necessary tension to the fabric. Both of these arrangements are relatively unsatisfactory in that the wing nuts generally used are cumbersome providing interference with the user when manipulating the frame and provide difficulty in adjustment.

A second difficulty in arrangements of this type is the technique for mounting the fabric onto the transverse bars. In most cases a short fabric strip is attached to the transverse bar and is then attached to the main fabric to be stitched by stitching an edge of the main fabric to the fabric strip. This is inconvenient, unattractive and prevents the fabric from being quickly and readily removed should the user wish to transfer to a different fabric.

SUMMARY OF THE INVENTION

It is one object of the present invention, therefore, to provide an improved needlepoint frame in which the technique for attachment of the fabric to the frame is improved and thus more convenient for the user.

It is a further object of the present invention to provide an improved needlepoint frame in which the adjustment of the transverse bars holding the fabric relative to the frame is improved and thus more convenient for the user.

According to one aspect of the invention there is provided a fabric mount for supporting a sheet of fabric comprising:

a first transverse member for attachment to one end of a fabric sheet;

a second transverse member for attachment to an opposed end of the fabric sheet;

two parallel side rails for supporting the transverse members in spaced position to hold the sheet of fabric in taut condition between the transverse members;

each transverse member having thereon an elongate longitudinal slot defining an elongate open mouth at a surface of the transverse member, a slot base opposite to the mouth and two slot sides for receiving a strip of the respective end of the fabric inserted into the mouth through the open mouth;

and each slot having associated therewith an elongate bar member for engagement into the slot and for locating the strip therein;

the bar member and the slot being shaped such that the bar member can be loosely inserted into the slot through the open mouth on top of the strip and such that tension in the fabric from one side of the transverse member pulls one side of the bar member into engagement with an adjacent slot side to pinch the fabric between the bar member and the slot side.

This type of fabric mounting avoids any rotatable elements or wing nuts to grasp and adjust the fabric.

Preferably the bar member is substantially rigid.

Preferably the slot side is inclined from the surface of the transverse member at an angle greater than ninety degrees.

Preferably the slot is wider than the bar member.

Preferably the bar member is of less height than the depth of the slot.

Preferably the bar member is tapered in cross-section so that its height at its side adjacent the slot side is less than its height at the opposite side.

Preferably the bar member is substantially triangular in cross-section.

Preferably the slot is shaped so as to increase in width from the mouth to the base.

Preferably the surface of each transverse member containing the slot is flat, the surfaces of the transverse members being co-planar.

Preferably each of the side rails includes a guide slot and at least one of the transverse members includes opposed portions thereof engaging into respective ones of the guide slots for longitudinal sliding movement therealong.

Preferably both of the transverse members includes opposed portions thereof engaging into respective ones of the guide slots for longitudinal sliding movement therealong, wherein the frame includes a pair of cross support members connecting the side rails to form a rigid rectangular structure.

Preferably one of the transverse members is mounted for course adjustment in the longitudinal direction and the other of the transverse members is arranged for fine adjustment in the longitudinal direction.

Preferably each of the side rails includes a plurality of holes each for receiving a locating pin for locating course adjustment of one of the transverse members.

Preferably each of the side rails, the cross members and the transverse members are substantially rectangular in cross-section so as to define a common plane containing sides of the rails and members in which the fabric is supported.

Preferably one of the cross members has a surface opposite to the transverse members which is curved in cross-section and wherein the adjacent transverse member is reversible such that the fabric can be wrapped around the curved surface and back to the transverse member.

Preferably there is provided at least one screw connected between one of the cross members and one of said transverse members for effecting fine adjustment of the transverse member in the longitudinal direction.

Preferably there is provided a female screw receptacle in one of the cross members for supporting a needle threading accessory for use in needlepoint.

Preferably there is provided a pair of mounting holes in one of the cross members for mounting a second frame.

According to a second aspect of the invention there is provided a fabric mount for supporting a sheet of fabric comprising:

a first transverse member for attachment to one end of a fabric sheet;

a second transverse member for attachment to an opposed end of the fabric sheet;

two parallel side rails for supporting the transverse members in spaced position to hold the sheet of fabric in taut condition between the transverse members;

wherein each of the side rails includes a guide slot and at least one of the transverse members includes opposed portions thereof engaging into respective ones of the guide slots for longitudinal sliding movement therealong;

both of the transverse members including opposed portions thereof engaging into respective ones of the guide slots for longitudinal sliding movement therealong;

the frame including a pair of cross support members connecting the side rails to form a rigid rectangular structure.

Preferably each of the side rails, the cross members and the transverse members are substantially rectangular in cross-section so as to define a common plane containing sides of the rails and members in which the fabric is supported. This type of adjustment of the frame using sliding elements avoids the necessity for wing nut type clamps which are cumbersome.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
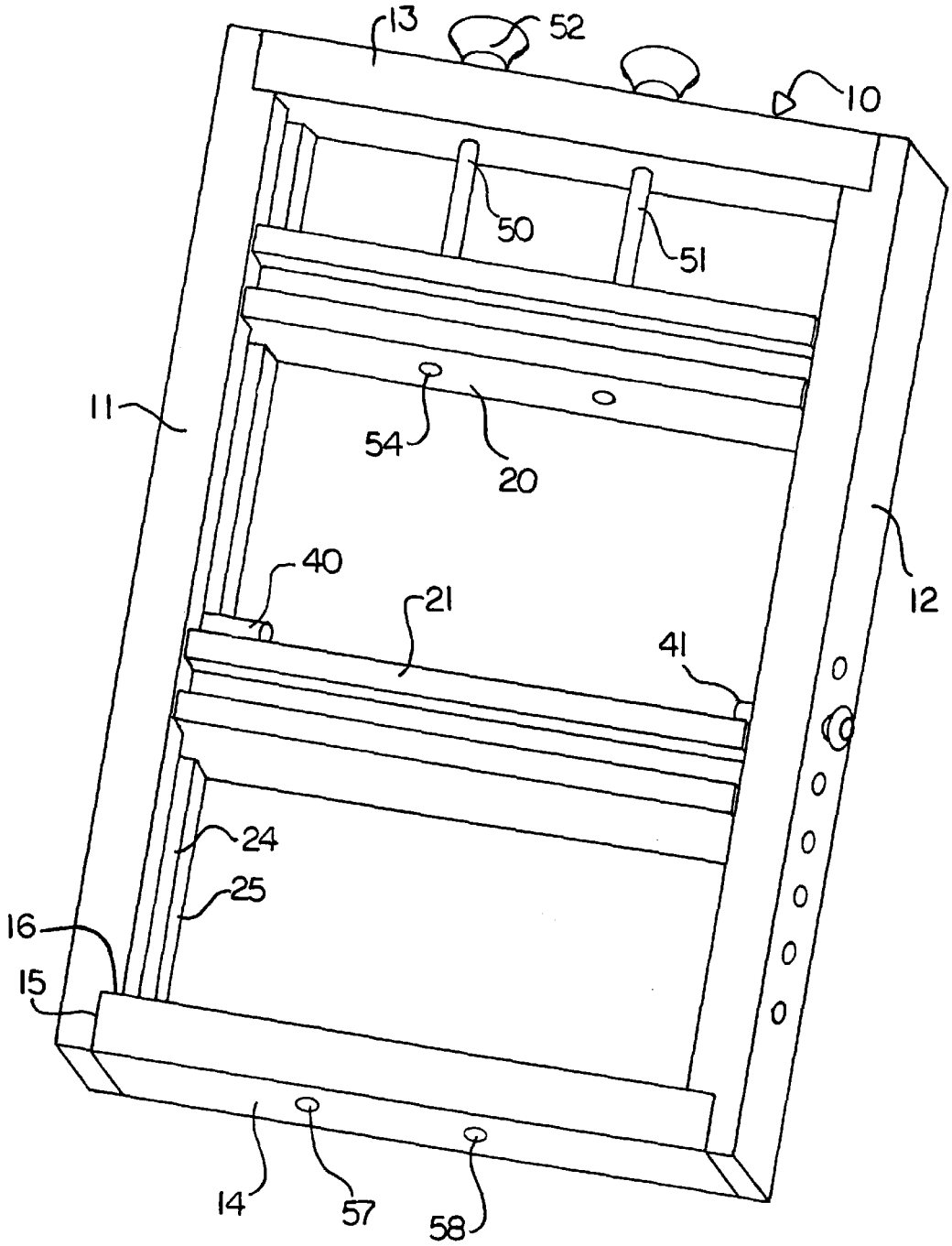
FIG. 1 is an isometric view of a needlepoint fabric mount according to the present invention.
Figure 2:
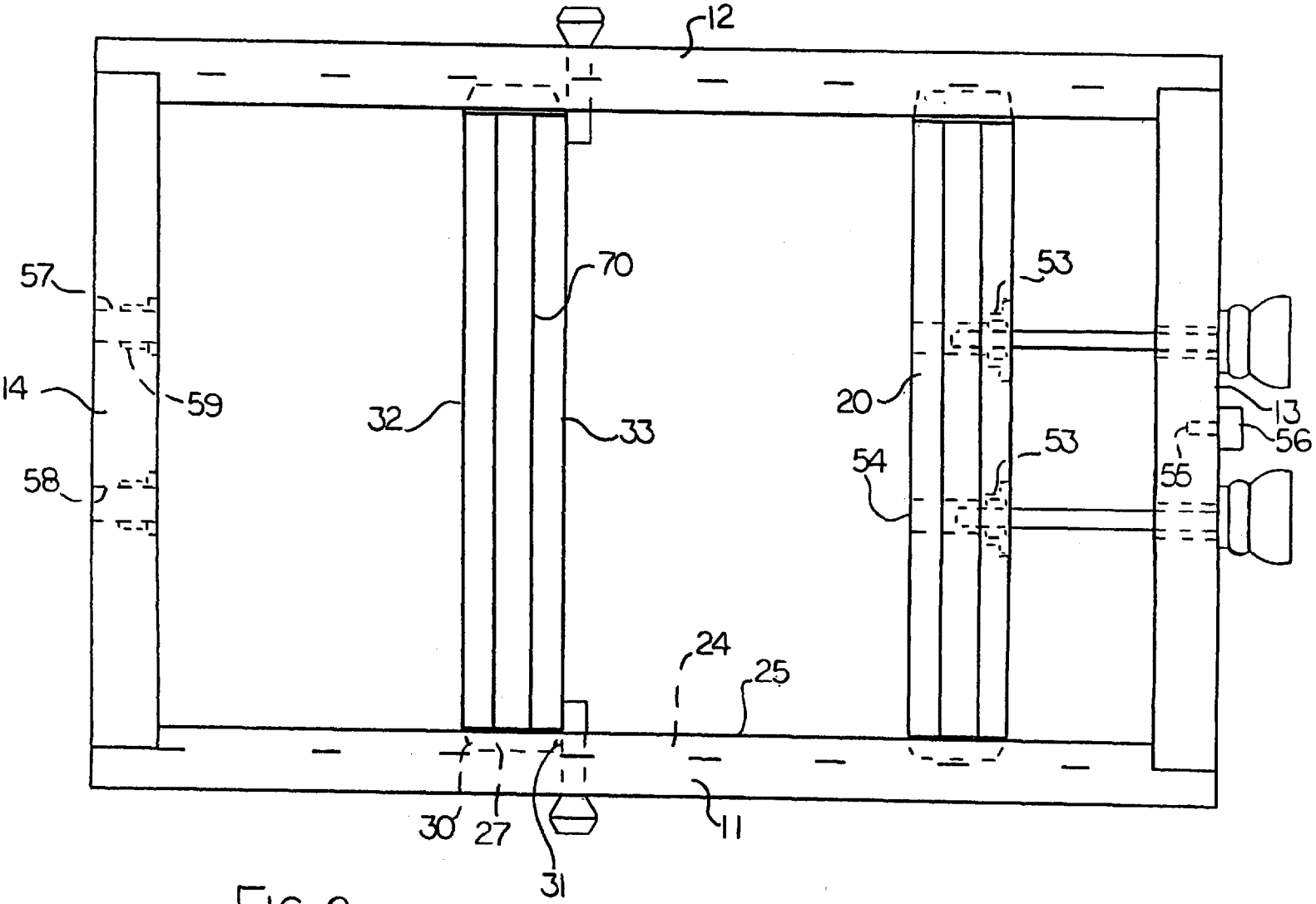
FIG. 2 is a top plan view of the needlepoint fabric mount of FIG. 1.

A needlepoint fabric mount or frame is indicated generally at 10 and comprises a rectangular outer frame structure defined by a pair of side rails 11 and 12 and two cross bars 13 and 14. The cross bars are arranged at the ends of the rails 11 and 12. One example of a suitable corner joint is shown which includes a recess 15 in the side rail defining a support surface 16 against which an inner face of the respective cross bar is engaged so that longitudinal compression forces on the frame are absorbed by the surface 16. Other constructions of joint well known to one skilled in the art can be employed. The frame is thus rigid and rectangular.

The cross bars and the rails are generally of square or rectangular cross section so as to define a front surface 17 of the frame and rear surface 18 of the frame. Each of the front and rear surfaces contains a surface of the side rails and the cross bars.

The frame further includes a pair of transverse support bars 20 and 21 for supporting a fabric strip 22 in either the plane of the surface 17 or the plane of the surface 18 as selected by the user.

Each of the side rails 11 and 12 has a recess 24 in an inside surface 25, the recess defining a channel along the length of the rail and located centrally of the surface 25. Each of the support bars 20 and 21 has a projecting plate 27 which extends outwardly to a respective end of the bar so as to engage into the channel 24 for sliding movement therealong.

Each of the cross bars 20 and 21 is also rectangular with an upper surface 28 co-planar with the surface 17 and a lower surface 29 co-planar with the surface 18. The projecting plates 27 are located at the ends of the support bars and have a length from a first end 30 to a second end 31 which is preferably equal to the height of the support bar between an end surface 32 and a second end surface 33. However the ends 30 and 31 are chamfered so that a length of the plate is slightly less at its end remote from the end of the support bar down its length at the support bar. This arrangement allows the length of the support bar to be substantially equal to the spacing between the inside surfaces 25 of the side rails so as to form a close sliding fit on the inside of the side rails while support bar can be pulled out of place by pulling one end downwardly away from the adjacent cross bar.

A plastic channel-shaped bearing 33 can be provided within the recess 24 to provide a smooth sliding action is preferred. In other arrangements the channel-shaped bearing can be omitted, depending upon the materials of manufacture.

Each of the support bars is therefore slidable longitudinally of the frame from positions abutting the respective cross bar to positions spaced inwardly therefrom. The outwardly facing surfaces of the support bars are maintained in the side surfaces of the frame by the sliding action. The sliding movement is simple and can be readily effected by manual operation by a user with limited physical capability.

One of the support bars is mounted for coarse adjustment in that it can slide from the cross bar inwardly to a position selected by a pair of pins 40 and 41 inserted through a selected one of a plurality of location holes 42. The holes 42 are arranged at the base of the recess 24 so the pin can be inserted centrally through the respective side rail with a head of the pin on an outside surface of the side rail and a cylindrical body of the pin passing through the side rail at the recess so as to project inwardly into engagement with the end surface 33 of the support bar.

The other of the support bars is mounted for fine adjustment. The fine adjustment is provided by a pair of screws 50 and 51 mounted in the cross bar 13 for rotation about an axis at right angles to the end face of the cross bar 13. Each screw has a manually operable head 52 which can be of any desired shape allowing for ease of rotation of the head by a person having limited physical capability. The screw is fixed against axial movement relative to the cross bar 13 and co-operates with a nut 53 mounted within a bore 54 in the support bar 20.

Adjustment of the spacing between the support bars can therefore be quickly and effectively made by firstly moving the support bar 21 to a first position approximating the required spacing to match the length of the fabric to be attached. With the fabric attached as described hereinafter, a fine adjustment can be effected by the screws so as to provide the necessary tension in the fabric.

The cross bar 13 has a central threaded recess 55 for receiving a needle threading accessory schematically indicated at 56. Such needle threading accessories are well known and commercially available but the provision of the threaded recess 55 in the end cross bar allows the mounting of the threading accessory in a convenient position for the user.

The cross bar 14 has a pair of holes 57 and 58 by which a second identical frame can be attached so as to increase the length of the frame structure to accommodate an increased length of fabric. When two such frames are attached, the screws 50 and 51 from the second frame are removed from the cross bar 13 of the second frame and are inserted through the cross bar 13 of the second frame into the holes 57 and 58 respectively so as to engage nuts 59 in the holes to bolt the cross bar 14 of the first frame to the cross bar 13 of the second frame.

Figure 3:
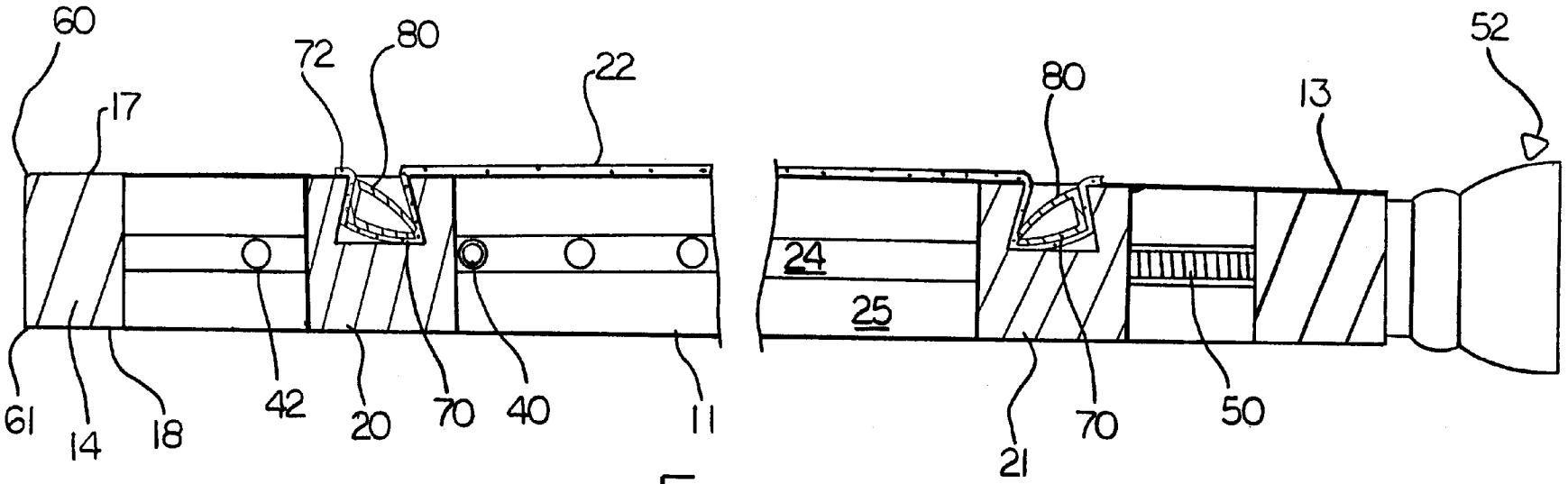
FIG. 3 is a longitudinal cross-sectional view of the needlepoint fabric mount of FIG. 1.

The cross bar 14 as best shown in FIG. 3 has radiused corners 60 and 61 which allows the fabric to be wrapped around the cross bar 14. In the situation where a particularly long piece of fabric is used, the fabric can be wrapped from support bar 21 around the cross bar 14 and back to the support bar 20. Preferably in this arrangement, the support bar 20 is removed from its position as shown in FIG. 3 and is inverted so that the mounting assembly for the fabric is on the underside of the support bar for co-operation with the fabric passing around the cross bar 14 and lying in the plane of the surface 18.

Figure 4:
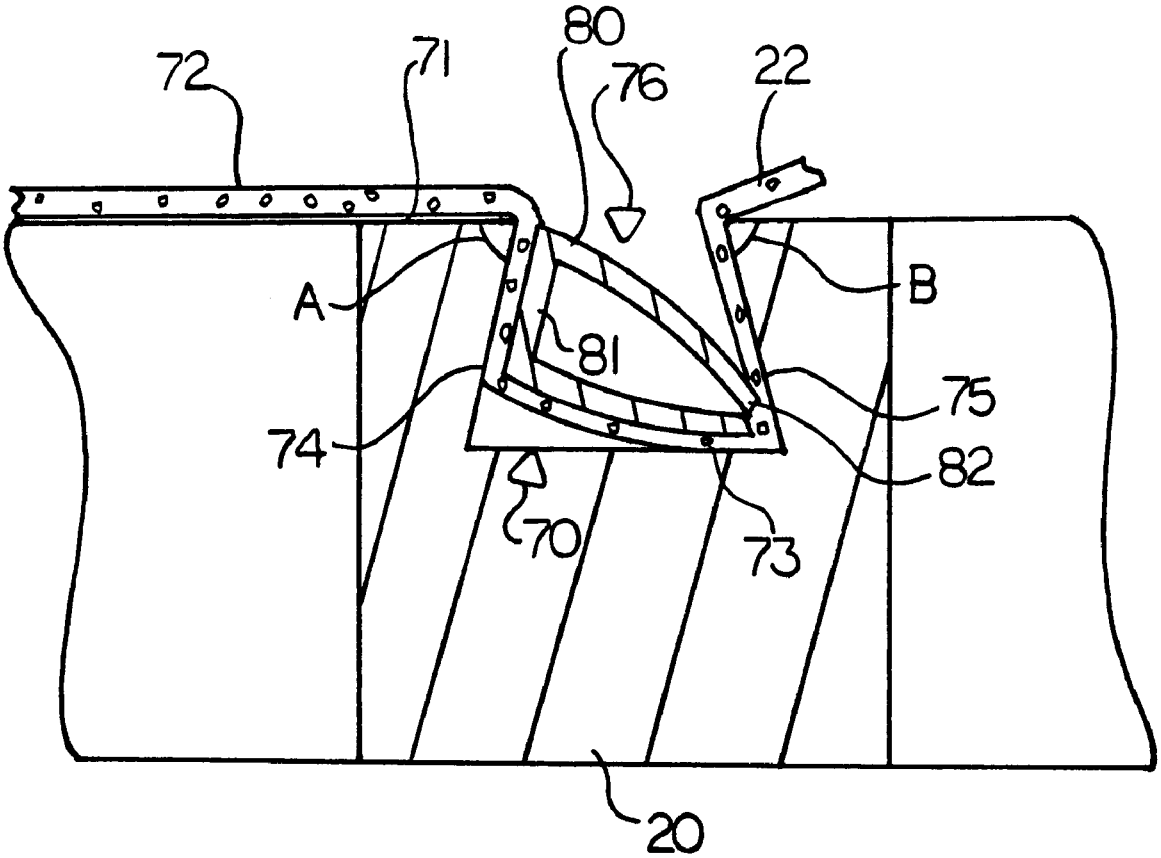
FIG. 4 is a cross-sectional view on an enlarged scale of the transverse bar of FIG. 3.
Figure 5:
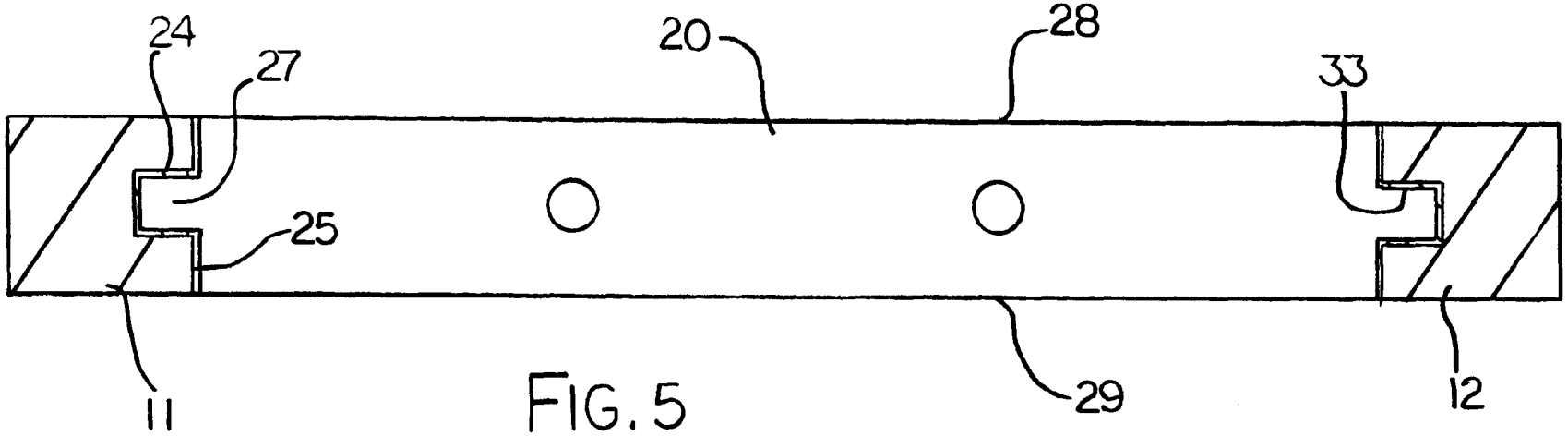
FIG. 5 is a transverse cross-sectional view of the needlepoint fabric mount of FIG. 1.

Turning now to FIGS. 3 and 4, there is shown the system for mounting the fabric 22 on the support bars 20 and 21.

For this purpose the support bars 20 and 21 each include a groove 70 in the upper surface 71 for receiving and grasping an edge 72 of the fabric 22.

The groove 70 includes a flat base 73 parallel the surface 71 together with two sides 74 and 75. The side 74 is arranged at an angle A to the surface 71 and the side 75 is arranged at an angle B to the surface 71. Each of these angles is arranged to be less than 90° so that the sides diverge outwardly from a mouth 76 of the groove toward the base 73. Thus the groove is of greater width at the base 73 than it is at the mouth 76 at the surface 71. The angle B may be slightly smaller than the angle A that is the angle B may be of the order of 75° and the angle A is less important but may be up to 90° and preferably of the order of 80°. Preferably the angle B lies in the range 60° to 80°.

The slot co-operates with a locking bar 80 in the form of an elongate member having a length substantially equal to the length of the slot. The elongate locking bar is generally triangular in cross section having a top plate 81 and converging down to a bottom apex 82. The height of the locking bar from the apex 82 to the top 81 is slightly less than the distance between the bottom of the side 75 and the opposite part of the side 74. Thus as shown in FIG. 4, the locking bar can be freely inserted into the slot by pushing the apex 82 toward the bottom of the side 75 and then allowing the top 81 to pass through the mouth to slide across the side 74. The angle of the side 74 is preferably arranged so that it matches approximately the angle of the top 81 of the triangular locking bar. The dimensions of the locking bar are such that fabric of various thicknesses can be wrapped around the locking bar in the manner as shown in FIG. 4 while the locking bar can be loosely inserted into the slot. The width of the mouth of the slot is however less than the height of the locking bar from the apex to the top so that the locking bar is prevented from being twisted in a counterclockwise direction lifting the apex upwardly along the side 75 since the apex will bind upon side 75 before significant upward movement of the apex occurs. The angle of the side 74 tends to push the locking bar and particularly its apex 82 into the V-shaped area between the side 75 and the base 73. The tension on the fabric 22 tends to pull the apex 82 upwardly thus wedging the locking bar into the slot due to its dimensions as described above. However pulling on the tail portion 72 of the fabric allows the top of the locking bar to be pulled out of the slot thus releasing the locking and the fabric portion from the slot.

The locking bar in the example shown is hollow and formed with two legs converging to the apex 82. Such a device is commercially available as a clip for papers and is extruded in continuous length so that suitable lengths of the locking bar can be readily obtained. However a solid structure of the locking bar can also be used which provides the substantially triangular shape as shown.

As shown in FIG. 3, the fabric is thus held in place by the locking bars 80 within the slots 70. Tension on the fabric can be slightly increased by operating the screws 50 and 51 thus tending to pull the locking bars into position to more vigorously hold the fabric within the slots.

The fabric can therefore be quickly and easily inserted and located in place even by persons of limited physical capability. The fabric can be quickly and easily removed and replaced. Different thicknesses of fabric can be attached. There is no necessity for the fabric to be sewn or otherwise attached to existing fabric strips and the fabric is itself directly attached to the support bars. The locking arrangement does not in anyway damage or tear the fabric itself so that even expensive fabrics can be used and locked directly in place.

As the frame is attractive and substantially rigid, it can be used as a display stand by mounting a pair of legs on the side rails using the side pins so that the legs support the frame inclined upwardly and rearwardly from the bottom cross beam.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A fabric mount for supporting a sheet of fabric comprising:

a first transverse member for attachment to one end of a fabric sheet;

a second transverse member for attachment to an opposed end of the fabric sheet;

two parallel side rails for supporting the transverse members in spaced position to hold the sheet of fabric in taut condition between the transverse members;

and a pair of cross support members connecting the side rails to form a rigid rectangular structure;

each of the side rails including a guide slot therein and each of the transverse members including opposed portions thereof engaging into respective ones of the guide slots for longitudinal sliding movement of the respective transverse member therealong.

2. The fabric mount according to claim 1 wherein each of the side rails, each of the cross members and each of the transverse members are substantially rectangular in cross-section so as to define a common plane containing a side of each of the side rails, the cross members and the transverse members in which the fabric is supported.

3. The fabric mount according to claim 1 wherein one of the transverse members is mounted for course adjustment in the longitudinal direction and the other of the transverse members is arranged for fine adjustment in the longitudinal direction.

4. The fabric mount according to claim 1 wherein each of the side rails includes a plurality of holes each for receiving a locating pin for locating course adjustment of one of the transverse members.

5. The fabric mount according to claim 1 wherein each of the side rails, the cross members and the transverse members are substantially rectangular in cross-section so as to define a common plane containing sides of the rails and members in which the fabric is supported.

6. The fabric mount according to claim 1 wherein one of the cross members has a surface opposite to the transverse members which is curved in cross-section and wherein the adjacent transverse member is reversible such that the fabric can be wrapped around the curved surface and back to the transverse member.

7. The fabric mount according to claim 1 wherein there is provided at least one screw connected between one of the cross members and one of said transverse members for effecting fine adjustment of the transverse member in the longitudinal direction.

8. The fabric mount according to claim 1 wherein there is provided a female screw receptacle in one of the cross members for supporting a needle threading accessory for use in needlepoint.

9. The fabric mount according to claim 1 wherein there is provided a pair of mounting holes in one of the cross members for mounting a second fabric mount.

10. A fabric mount for supporting a sheet of fabric comprising:

a first transverse member for attachment to one end of a fabric sheet;

a second transverse member for attachment to an opposed end of the fabric sheet;

two parallel side rails for supporting the transverse members in spaced position to hold the sheet of fabric in taut condition between the transverse members;

each transverse member having a surface thereof against which the fabric is held such that the fabric extends from the surface away from one side of the transverse member toward the other of the transverse members;

the surface of each transverse member having therein an elongate longitudinal slot defining an elongate open mouth at the surface for receiving an edge strip portion of the respective end of the fabric inserted into the slot through the open mouth;

the slot having a first slot side adjacent said one side of the transverse member, a second slot side opposite the first slot side and a slot base opposite to the mouth and between the first and second slot sides;

the first slot side being inclined from the surface of the transverse member at an angle less than ninety degrees such that the slot base extends further toward said one side than does the open mouth;

the slot of each transverse member having associated therewith an elongate rigid bar member for engagement into the slot and for locating the edge strip portion therein;

the bar member being shaped in cross-section to define an apex at one side, an opposed side, a top and a bottom, the top and bottom converging at said one side to define said apex;

the bar member having a height between the top and bottom thereof which is less than a width thereof between the apex and said opposite side such that the bar member can be loosely inserted into the slot through the open mouth on top of the edge strip portion with said opposed side of the bar member to a first position thereof with the apex of the bar member adjacent the first side of the slot and said opposite side adjacent the second side of the slot;

the bar member having a width of the bottom between the apex and said opposed side which is no greater than the width of the slot base such that the bottom of the bar member in said first position thereof lies on the slot base;

the bar member having a width between the apex and said opposed side of the bar member which is arranged relative to the angle of the first side of the slot such that, when the bar member is rotated by tension in the fabric from said first position in a direction in which the apex moves from the slot base along the first side of the slot toward the open mouth, the apex engages the first side while said opposed side of the bar member engages the second side at the slot base so as to wedge the bar member between the first side and the second side and to pinch the fabric between the apex of the bar member and the first side of the slot.

11. The frame according to claim 10 wherein each of the side rails includes a guide slot and at least one of the transverse members includes opposed portions thereof engaging into respective ones of the guide slots for longitudinal sliding movement therealong.

12. The fabric mount according to claim 11 wherein both of the transverse members includes opposed portions thereof engaging into respective ones of the guide slots for longitudinal sliding movement therealong, wherein the fabric mount includes a pair of cross support members connecting the side rails to form a rigid rectangular structure.

13. The fabric mount according to claim 12 wherein one of the transverse members is mounted for course adjustment in the longitudinal direction and the other of the transverse members is arranged for fine adjustment in the longitudinal direction.

14. The fabric mount according to claim 12 wherein each of the side rails includes a plurality of holes each for receiving a locating pin for locating course adjustment of one of the transverse members.

15. The fabric mount according to claim 12 wherein each of the side rails, the cross members and the transverse members are substantially rectangular in cross-section so as to define a common plane containing sides of the rails and members in which the fabric is supported.

16. The fabric mount according to claim 12 wherein one of the cross members has a surface opposite to the transverse members which is curved in cross-section and wherein the adjacent transverse member is reversible such that the fabric can be wrapped around the curved surface and back to the transverse member.

17. The fabric mount according to claim 12 wherein there is provided at least one screw connected between one of the cross members and one of said transverse members for effecting fine adjustment of the transverse member in the longitudinal direction.

18. The fabric mount according to claim 12 wherein there is provided a female screw receptacle in one of the cross members for supporting a needle threading accessory for use in needlepoint.

19. The fabric mount according to claim 12 wherein there is provided a pair of mounting holes in one of the cross members for mounting a second fabric mount.

* * * * *